United States Patent [19]

Ishigaki

[11] Patent Number: 4,715,595

[45] Date of Patent: Dec. 29, 1987

[54] APPARATUS FOR FEEDING PAPER SHEETS FROM A PAPER STOCK TO A PRINTER OR READER

[75] Inventor: Toshinori Ishigaki, Tokyo, Japan

[73] Assignee: Kabushiki Kaisha Toshiba, Kawasaki, Japan

[21] Appl. No.: 814,759

[22] Filed: Dec. 30, 1985

[30] Foreign Application Priority Data

Dec. 28, 1984 [JP] Japan ..... 59-276221

[51] Int. Cl.[4] ..... B65H 7/14; B65H 3/06

[52] U.S. Cl. ..... 271/110; 271/117; 271/121; 400/624; 400/629

[58] Field of Search ..... 271/109, 117, 39, 110, 271/111, 114–128, 140, 171, 121, 124, 21, 105, 165, 169; 414/113, 117, 123; 400/624, 629, 615, 615.1

[56] References Cited

U.S. PATENT DOCUMENTS

| | | | |
|---|---|---|---|
| 776,837 | 12/1904 | Hallberg | 271/117 |
| 928,637 | 7/1909 | Davidson | 271/117 |
| 2,378,306 | 6/1945 | Leonhart | 271/165 |
| 3,476,381 | 11/1969 | Carlson | 271/117 |

FOREIGN PATENT DOCUMENTS

| | | | |
|---|---|---|---|
| 0626126 | 8/1961 | Canada | 271/117 |
| 465682 | 9/1928 | Fed. Rep. of Germany | 271/169 |
| 2436354 | 2/1976 | Fed. Rep. of Germany | 271/165 |

OTHER PUBLICATIONS

Habich et al., "Envelope Picker-Separator", IBM Tech. Disclosure Bulletin, vol. 19, No. 3, Aug. 1976, pp. 746–747.

*Primary Examiner*—Joseph J. Rolla
*Assistant Examiner*—Edward S. Ammeen
*Attorney, Agent, or Firm*—Finnegan, Henderson, Farabow, Garrett & Dunner

[57] ABSTRACT

A paper feeder includes a paper feeder main body arranged above a rectangular, parallelepiped stack of sheets. A support mechanism for supporting the main body above the stack is provided on the paper feeder main body. A feed roller is supported by the paper feeder main body and in contact with the uppermost sheet to feed the uppermost sheet in a predetermined direction. Metal pawls for allowing movement of the uppermost sheet and preventing movement of the other sheets are likewise supported by the paper feeder main body. The mechanism moves downward together with the paper feeder main body in accordance with a change in the height of the stack upon sheet feed, thereby supporting the paper feeder main body and metal pawls at a predetermined position with respect to the uppermost sheet.

12 Claims, 10 Drawing Figures

APPARATUS FOR FEEDING PAPER SHEETS FROM A PAPER STOCK TO A PRINTER OR READER

BACKGROUND OF THE INVENTION

The present invention relates to a paper feeder used together with a printer and a reader.

An automatic paper feeder generally has a hopper containing paper sheets to be fed into the paper feeder, and a feed roller arranged above the hopper. The hopper is urged toward the feed roller by a spring, and the uppermost sheet in the hopper is therefore urged against the feed roller. When the feed roller is driven in this state, sheets in the hopper are fed one by one into the apparatus, beginning with the uppermost sheet. When the uppermost sheet in the hopper is fed, however, the second and/or third sheets may also be fed into the apparatus with the uppermost sheet due to friction. For this reason, the paper feeder is provided with metal pawls to prevent feeding of the second and/or third sheets and to allow only the uppermost sheet to be fed into the printer.

In the paper feeder of the type described above, the hopper can contain a maximum of 50 to 100 sheets. When 100 or more sheets are set in the hopper, a spring having a large urging force must be used to urge the hopper upward. When such a strong spring is used, the uppermost sheet is urged against the feed roller with greater pressure as the number of sheets in the hopper decreases, necessitating that the feed roller be driven by a larger force and, consequently, that a larger drive motor be provided. Moreover, because the friction between sheets is increased by the pressure by which they are compressed, the problem of double feed or misfeed is all that much more prevalent.

SUMMARY OF THE INVENTION

The present invention has been devised in consideration of the above circumstances and is intended to provide a paper feeder which can reliably feed paper sheets into an apparatus one by one, beginning with the uppermost sheet.

In order to achieve the above object, the main body of the paper feeder of the present invention is arranged above a rectangular, parallelepiped stack of sheets, feeds the sheets one by one from the uppermost sheet, and moves in accordance with changes in the height of the stack of sheets upon sheet feed.

The paper feeder according to the present invention comprises a main body arranged above the uppermost sheet of the sheet stack; a feed roller, supported by the main body and in contact with the uppermost sheet, for feeding the uppermost sheet in a predetermined direction; drive means for driving the feed roller; regulating means, arranged at a predetermined position with respect to the uppermost sheet, for allowing movement of the uppermost sheet and preventing movement of the other sheets; and support means, movable in accordance with a change in the height of the sheet stack upon sheet feed, for supporting the main body and the regulating means at predetermined positions with respect to the uppermost sheet.

BRIEF DESCRIPTION OF THE DRAWINGS

FIGS. 1 to 5 show a printer with an automatic paper feeder according to a first embodiment of the present invention, in which FIG. 1 is a perspective view of the overall printer, FIG. 2 is an enlarged perspective view of a metal pawl, FIG. 3 is a plan view of a control circuit, and FIGS. 4 and 5 are side views showing the paper feeder in different modes;

FIGS. 6 to 8 show a paper feeder according to a second embodiment of the present inventon, in which FIG. 6 is a side view of the feeder and FIGS. 7 and 8 are side views showing a main portion of the feeder in different modes.

DETAILED DESCRIPTION OF THE PREFERRED EMBODIMENTS

The preferred embodiments of the present invention will now be described with reference to the accompanying drawings.

Figure 1:
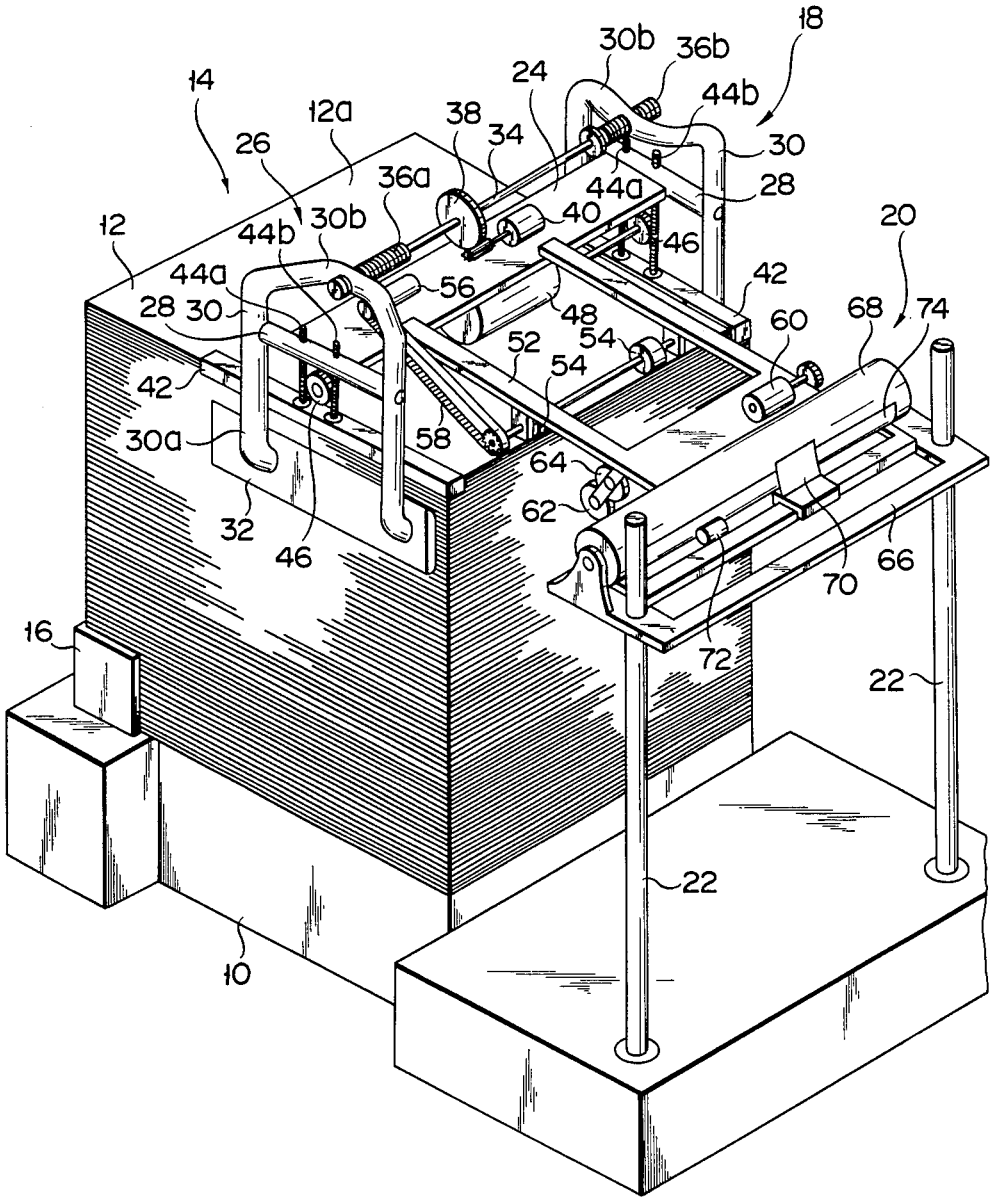

FIG. 1 shows a printer with a paper feeder according to a first embodiment of the present invention. The printer has base plate 10. Rectangular, parallelepiped paper stack 14 of, for example, A4 sheets 12 is placed on base plate 10. Paper stack 14 is located at a predetermined position by positioning projections 16 fixed to plate 10. Paper feeder 10 of the printer is arranged above stack 14, and printer main body 20 supported by feeder 18 with which it is movable. The movement of printer main body 20 is guided by a pair of guide rods 22 which are positioned on base plate 10.

Figure 4:
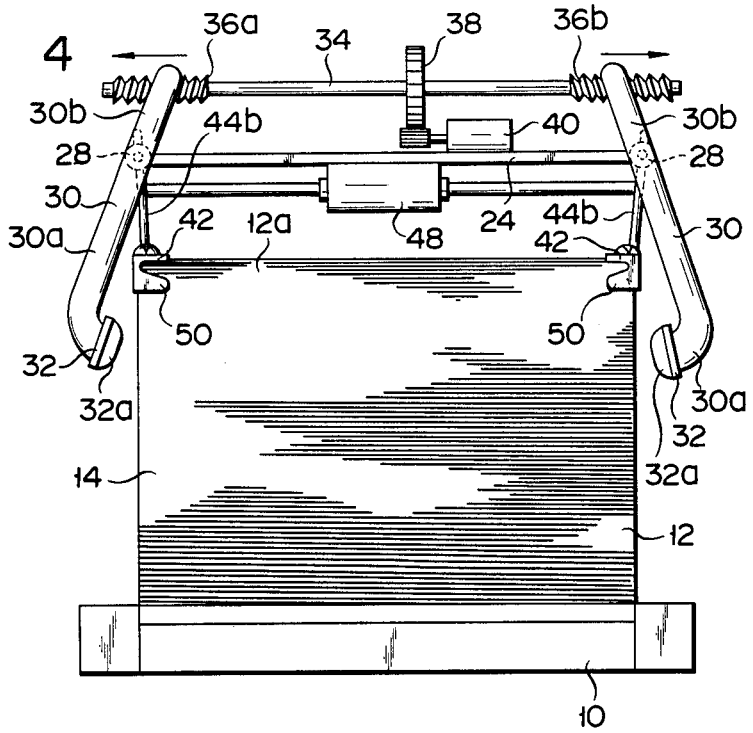

As shown in FIG. 1, paper feeder 18 has plate-like main body 24 above uppermost sheet 12*a* of stack 14. Paper feeder main body 24 has a length substantially equal to the width of sheet 12 and is arranged to extend in the widthwise direction of sheet 12. Paper feeder main body 24 is supported by support mechanism 26 at a predetermined distance from uppermost sheet 12*a*. Support mechanism 26 has a pair of parallel support rods 28 fixed to either end of main body 24, and a pair of support frames 30 pivotally supported by respective rods 28. Each support frame 30 has lower portions 30*a* which extend downward from rod 28, i.e., toward stack 14, and upper portions 30*b* which extend upward from rod 28. Support plates 32 are fixed to the ends of lower portions 30*a* so that they can be positioned to press against their corresponding sides of stack 14. Hold members 32*a*, of an elastic material having a large frictional coefficient such as rubber or sponge, are attached to that surface of support plates 32 which faces the side of stack 14, as shown in FIG. 4. Upper portions 30*b* of support frames 30 are coupled by drive shaft 34. Thus, drive shaft 34, with threaded portions 36*a* and 36*b* formed on its ends, is located above main body 24. Oppositely threaded portions 36*a* and 36*b* are screwed into upper portions 30*b* of support frames 30. Drive gear 38 is fixed to the central portion of shaft 34. Gear 38 meshes with a gear fixed to the rotating shaft of motor 40 arranged on main body 24.

When motor 40 is rotated in the forward direction, drive shaft 34 pivots support frames 30 in a direction such that upper portions 30*b* approach each other. When motor 34 is rotated in the reverse direction, drive shaft 34 pivots support frames 30 so that upper portions 30*b* are separated from each other. In so doing support plates 32 are pressed against the opposite sides of stack 14 to clamp stack 14 therebetween. As a result, paper feeder main body 24 is supported at a position above stack 14 by support frames 30.

Figure 2:
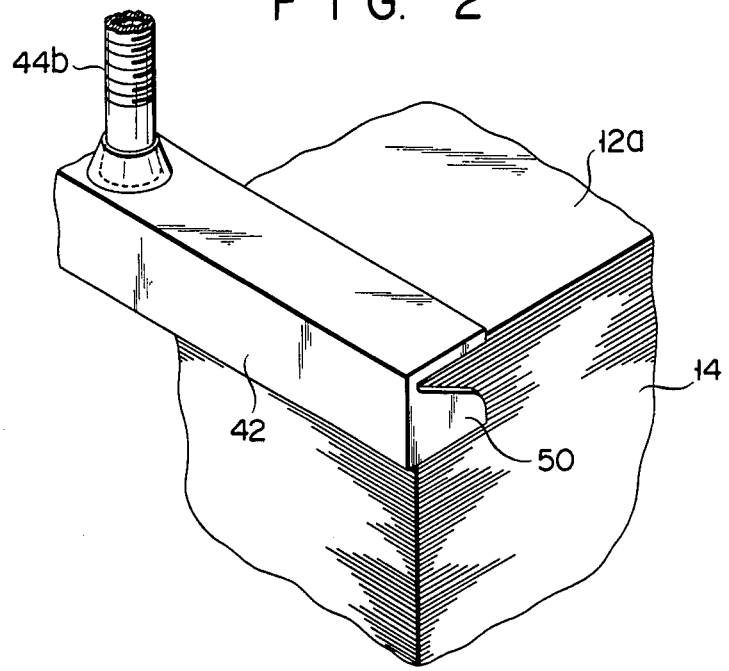

Support mechanism 26 has a pair of lift plates 42 which are respectively supported by support rods 28. Lift plates 42 are located parallel to the long sides of sheets 12 at a level between support rods 28 and plates 32. Each lift plate 42 has a L-shaped cross section and can engage with its corresponding long edge of stack 14. A pair of parallel lift rods 44*a* and 44*b* extend upward from each lift plate 42. The overall outer circumferential surface of each lift rod is threaded. As shown in FIG. 2, the lower ends of lift rods 44*a* and 44*b* are rotatably mounted on lift plate 42. The upper ends of lift rods 44*a* and 44*b* are screwed into corresponding support rod 28. Gear 46 is arranged between rods 44*a* and 44*b* and meshes therewith. Gears 46 are fixed to the rotating shaft of biaxial motor 48 which is fixed to paper feeder main body 24. When motor 48 is rotated in the forward direction, rods 44*a* and 44*b* are rotated by corresponding gear 46 and moved upward together with lift plates 42. When motor 48 is rotated in the reverse direction, lift plates 42 are moved downward together with lift rods 44*a* and 44*b*.

The front end of each lift plate 42 extends to one corner of stack 14 and has regulating pawl 50, as shown in FIG. 2. Pawls 50 constitute regulating means for allowing movement of only uppermost sheet 12*a* of stack 14 and regulating movement of the other sheets.

A pair of support arms 52 extend from paper feeder main body 24 to the front in a direction parallel to the long sides of sheets 12. A pair of feed rollers 54 are rotatably supported on support arms 52 and contact uppermost sheet 12*a*. Feed rollers 54 are urged toward uppermost sheet 12*a* by springs (not shown). Feed rollers 54 are driven, through belt 58, by paper feed motor 56 which is fixed on main body 24. At the distal ends of support arms 52 are arranged motor 60, driven supply rollers 62, and follower rollers 64 which rotate interlockingly with rollers 62.

Printer main body 20 has outer frame 66 which is fixed to extended ends of support arms 52 of paper feeder 18. Outer frame 66 is guided along guide rods 22, described above. Platen 68, printing head 70, pressure roller 72, and metal paper guide 74 are arranged on outer frame 66.

Figure 3:
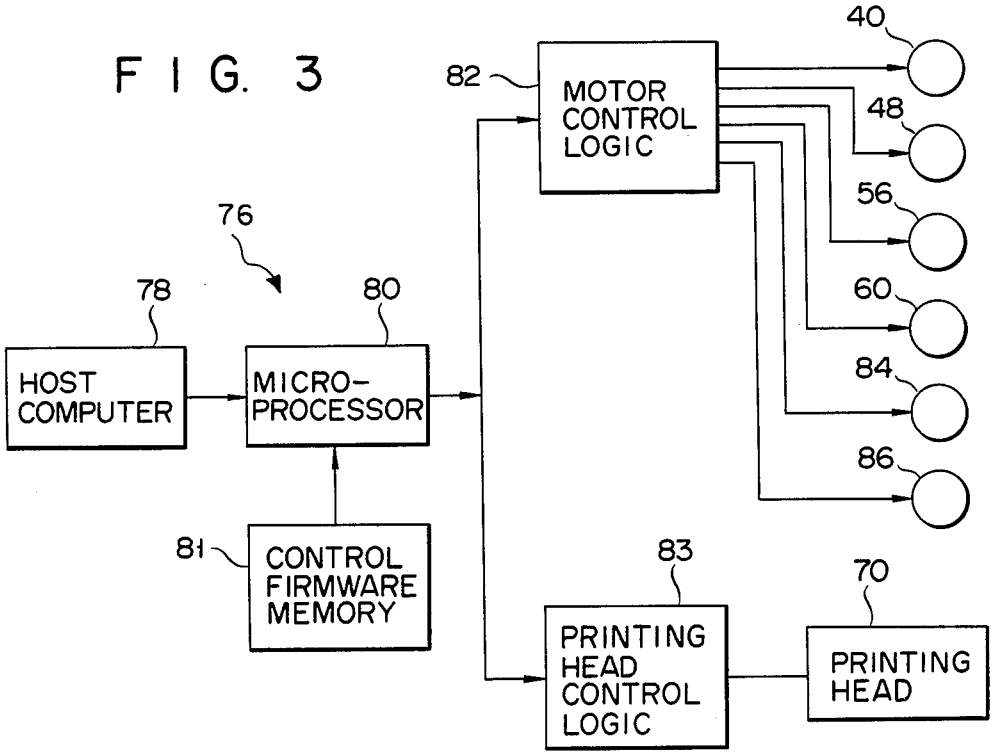

Controller 76, for controlling the operation of paper feeder 18 and printer main body 20, is arranged in base plate 10. As shown in FIG. 3, controller 76 has microprocessor 80 for receiving printing data and various control data from host computer 78. Microprocessor 80 operates in accordance with the program stored in firmware memory 81 and controls motor control logic 82 and head control logic 83. Head control logic 83 controls operation of the printing head of printer main body 20. Motor control logic 82 controls the operation of motors 40, 48, 56 and 60, platen drive motor 84 and head drive motor 86. These motors are stepping motors.

The operation of the printer having the above configuration will now be described. Stack 14 of sheets 12 is located at a predetermined position on base plate 10. Paper feeder 18 is set on stack 14 and printer main body 20 is engaged with guide rods 22. At the beginning of the paper feed operation, lift plates 42 are in the first position a predetermined distance from support rods 28, and support plates 32 are in the open position where they are separated from stack 14. As shown in FIG. 4, lift plates 42 are placed on the edges of stack 14 to press stack 14 and support paper feeder main body 24 above stack 14. In this state, support plates 32 are separated from the sides of stack 14, and feed rollers 54 are in contact with uppermost sheet 12*a*.

Figure 5:
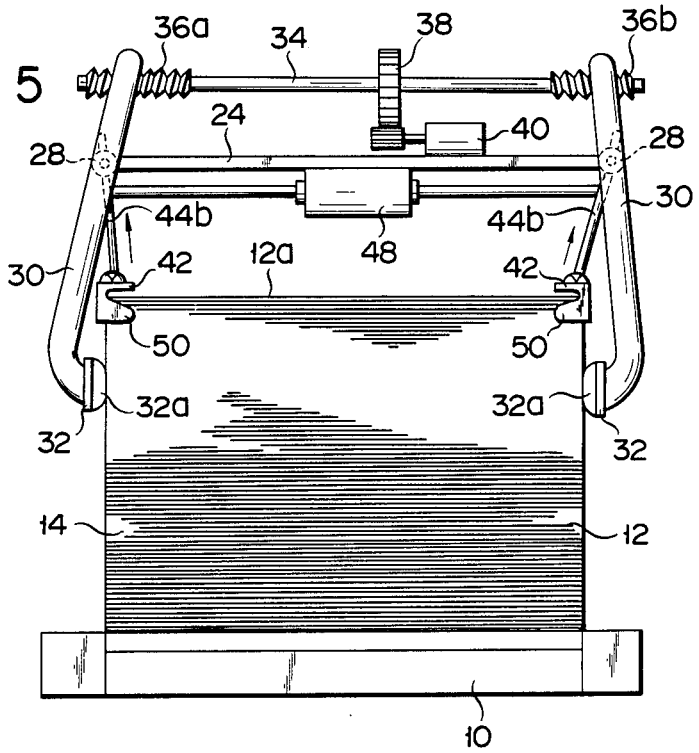

Thereafter, microprocessor 80 controls motor control logic 82 in response to a signal from host computer 78, and drives motor 40. When motor 40 is rotated in the reverse direction, gear 38, shaft 34, and threaded portions 36*a* and 36*b* are rotated, and support frames 30 move in a direction such that support plates 32 are brought towards each other. Therefore, as shown in FIG. 5, support plates 32 are moved to assume the clamping position in which they are pressed against the sides of stack 14 through sponges 32*a*, thereby clamping stack 14.

Subsequently, motor 48 is rotated in the forward direction and gears 46 are rotated under the control of microprocessor 80 and motor control logic 82. Lift rods 44*a* and 44*b* are rotated, screwed into support rods 28 and moved upward. Lift plates 42 are moved into the second position shown in FIG. 5, together with lift rods 44*a* and 44*b*. In the second position, lift plates 42 are slightly separated from uppermost sheet 12*a*, and metal pawl 50 releases sheet 12*a* and regulates movement of the other sheets.

Microprocessor 80 then drives motor 56 through motor control logic 82, and feed rollers 54 are driven through belt 58. Uppermost sheet 12*a* is then fed toward printer main body 20 by feed rollers 54. Paper feeder main body 24 is, at this time, supported by support plates 32 which are pressed against the sides of stack 14, and lift plates 42 are not in contact with stack 14. Because, upper sheets 12 of stack 14 are not pressed by lift plates 42, little friction exists between sheets 12, and uppermost sheet 12*a* can be easily fed using only a small driving force. When motor 56 is driven, microprocessor 80 and motor control logic 82 drive motor 60, and rollers 62 and 64 are rotated. Sheet 12, fed by rollers 54, is supplied to platen 68 of printer main body 20 by rollers 62 and 64.

Sheet 12 is supplied to platen 68 and urged against its surface by pressure roller 72. Motors 84 and 86 are driven by microprocessor 80 and logic 82 and in turn drive platen 68 and head 70. In accordance with the control operation of microprocessor 80 and logic 83, head 70 prints the desired information on sheet 12

After printing, motor 48 is rotated by the control operation of microprocessor 80 and logic 82, and plates 42 are moved downward to the first position. Since one sheet has been fed from stack 14, plates 42 are, in the first position, separated from uppermost sheet 12*a* by a distance corresponding to the thickness of one sheet. Thereafter, motor 40 is rotated in the forward direction, and support plates 32 are moved into the open position where they are separated from stack 14. Support of paper feeder main body 24 is relaxed, and feeder 18 and printer main body 20 fall a distance equal to the thickness of one sheet until plates 42 contact the edges of stack 14; thus restoring the state shown in FIG. 4. Repetition of the described process enables continuous printing of paper sheets.

Unlike conventional printers, in the printer having the above configuration, rather than having the stack of paper sheets move, the paper feeder is itself moved in accordance with a change in the height of the stack. Therefore, even if a large number of sheets are stacked, neither the friction between sheets, or the pressure of the feed rollers acting on the uppermost sheet will increase. Consequently, paper feed errors such as double feed can be prevented, and sheets can be reliably fed one by one, beginning with the uppermost sheet, into the printer. Of significance is the fact that reliable feeding of sheets into the printer can be achieved through use of a feed roller motor whose drive force is relatively small. Of somewhat lesser significance but of no less convenience is the fact that a large number of sheets can be set at one time, overcoming the need for frequent resetting.

Although, paper feeder 18 is, in the above embodiment, moved downward each time a sheet is fed, the present invention is by no means limited to this particular arrangement. For example, only the lift plates need be moved downward until a plurality of, say 10 sheets have been fed, after which the paper feeder as a whole can be moved downward.

Figure 6:
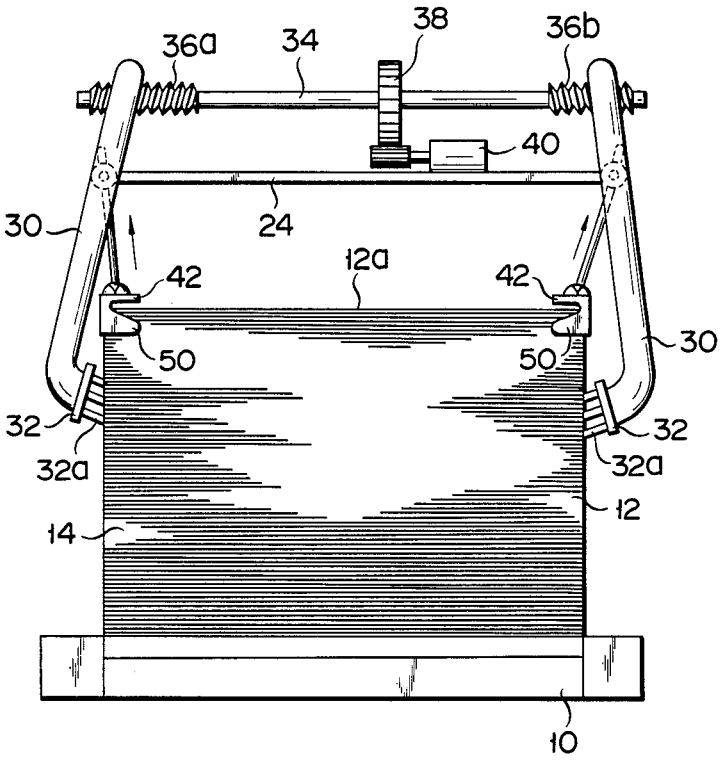
Figure 7:
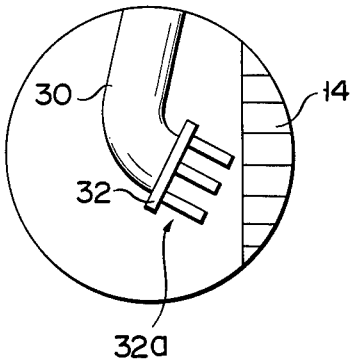
Figure 8:
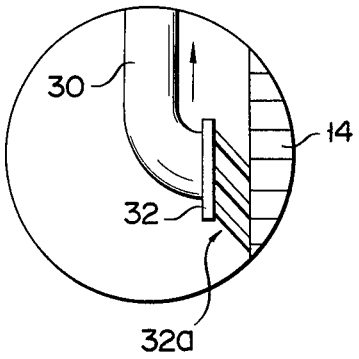

FIGS. 6 to 8 show a second embodiment of the present invention. In this embodiment, hold members 32*a* of support plates 32 comprise brush-like members having a number of bristles consisting of rubber or a synthetic resin.

As shown in FIGS. 7 and 8, when support plates 32 of the apparatus of the second embodiment are moved toward the sides of stack 14, the distal ends of bristle members 32*a*, contact the sides of stack 14. When support plates 32 are moved further, the bristles of the brushes bend at their proximal ends. Then, paper feeder 18 is moved upward by a distance corresponding to the length of members 32*a*. For this reason, lift plates 42 need not be moved upward by motor 48, gears 46 and the like, as in the first embodiment, obviating the need for motor 48, gears 46 and the like.

Figure 9:
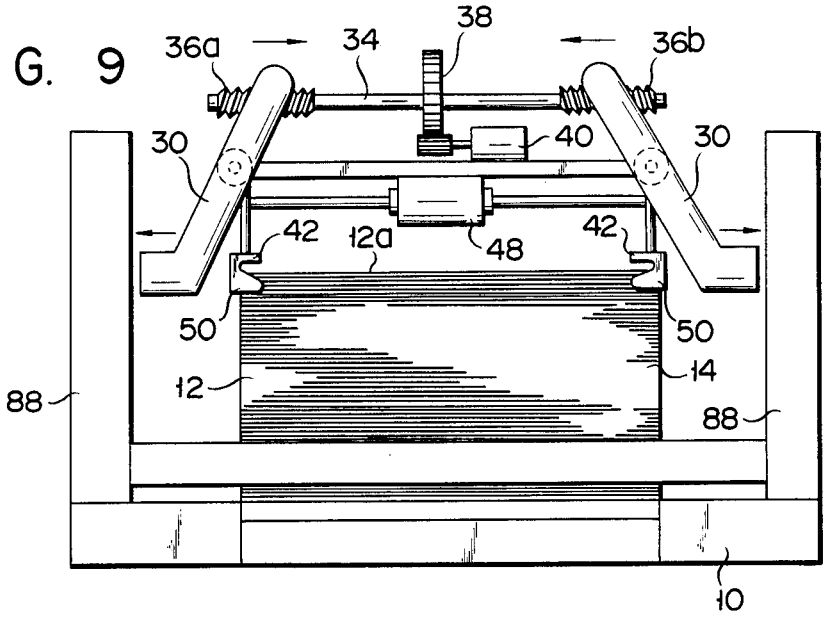
FIGS. 9 and 10 are a side view and a perspective view showing paper feeders according to third and fourth embodiments of the present invention.

FIG. 9 shows a third embodiment of the present invention. In this embodiment, fixed frames 88 are arranged on base plate 10. Frames 88 extend upward along the sides of stack 14. Support frames 30 do not have support plates, and support paper feeder main body 24 not by clamping stack 14, but by engaging with fixed frames 88.

In the second and third embodiments, parts identical to those in the first embodiment are denoted by the same reference numerals, and a detailed description thereof is omitted. The second and third embodiments can provide the same effects as the first embodiment.

Figure 10:
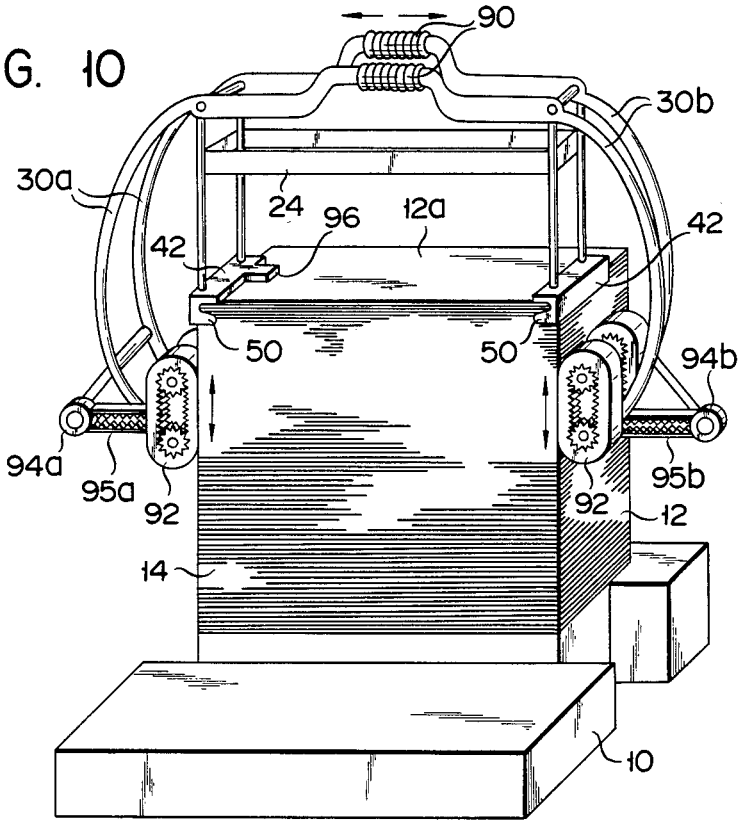

FIG. 10 shows a fourth embodiment of the present invention. In this embodiment, two sets of support frames, 30*a* and 30*b*, are pivotally mounted on main body 24. The intermediate portions of frames 30*a* and 30*b* are supported by body 24. The upper ends of frames 30*a* and 30*b* are coupled by compression springs 90, and the lower ends thereof are urged toward the sides of stack 14. Endless belts 92 are mounted on the lower ends of frames 30*a* and 30*b*, and are pressed against the sides of stack 14. Paper feeder main body 24 is supported by clamping stack 14 between belts 92. Belts 92 are driven, through drive belts 95*a* and 95*b*, by motors 94*a* and 94*b* which are fixed to support frames 30*a* and 30*b*. When belts 92 are driven, they move vertically, together with frames 30*a* and 30*b* and main body 24, along the sides of stack 14.

A pair of lift plates 42 are fixed to main body 24 through rods 44*a* and 44*b*. Photosensor 96, as a position sensor, is mounted on one plate 42 such that it opposes uppermost sheet 12*a*. Sensor 96 detects the distance between plates 42 and uppermost sheet 12*a*.

In the fourth embodiment, paper feeder 18 is, at the outset of the paper feed operation, set in the state shown in FIG. 10. To begin the operation, motors 94*a* and 94*b* are driven by a control device (not shown), moving the entire paper feeder apparatus downward. When plates 42 reach a position a predetermined distance from uppermost sheet 12*a*, i.e., when pawls 50 reach a position such that they allow movement of uppermost sheet 12*a*, photosensor 96 outputs a detection signal to stop motors 94*a* and 94*b*. Thereafter, uppermost sheet 12*a* is supplied to printer main body 20 by feed rollers.

The fourth embodiment can provide the same effect as the first embodiment. The position sensor is not limited to a photosensor: a pressure sensor can be used instead, in which case motors 94*a* and 94*b* are stopped when the detection output (signal) from the pressure sensor reaches a predetermined value.

The present invention is not limited to the particular embodiments described above; various changes and modifications may be made without departing from the spirit and scope of the present invention. For example, though in the first embodiment the paper feeder is used in combination with a printer, the paper feeder of the present invention can be combined with a reader. A reader can be obtained by replacing printing head 70 of printer main body 20 with a photoelectric transducer head. When a paper feeder is combined with a reader, stacked sheets on which desired information is printed, are fed into the reader via the feeder.

Similarly, though in the first embodiment printer main body 20 is guided by guide rods 22 on base plate 10, guide rods 22 can be omitted. Likewise, the endless belts used in can be replaced with the fourth embodiment elastic rollers.

What is claimed is:

1. A paper feeder for sequentially feeding sheets from the top of a rectangular, parallelepiped stack in a predetermined direction, comprising:

a paper feeder main body arranged above the sheet stack;

a feed roller, supported by said paper feeder main body and in contact with the uppermost sheet, for feeding the uppermost sheet in a predetermined direction;

drive means for driving said feed roller;

regulating means, arranged at a predetermined position with respect to the uppermost sheet, for allowing movement of the uppermost sheet and preventing movement of the other sheets; and support means, movable in accordance with a change in the height of the sheet stack upon sheet feed, for supporting said paper feeder main body and the regulating means at predetermined positions with respect to the uppermost sheet, said support means including a pair of support frames pivotally mounted on said paper feeder main body, a pair of support plates fixed to said support frame and capable of pressing against the respective sides of the sheet stack, an open/close mechanism for pivoting said support frames to a closed position where said support plates are pressed against said sides of the stack to clamp the stack therebetween, and to an open position where said support plates are separated from the sides of the stack, and a pair of lift plates which are supported by said paper feeder main body and which can simultaneously contact the edges on either side of the stack.

2. A paper feeder according to claim 1, wherein said support means includes hold members which are fixed to said support plates and capable of being pressed against the sides of the stack, said hold members having elastic brushes with a number of bristles.

3. A paper feeder according to claim 1, wherein said regulating means includes a pair of metal pawls fixed to said lift plates.

4. A paper feeder according to claim 3, wherein said lift plates are movably supported by said paper feeder main body, said support means includes a lift mechanism for moving said lift plates into, alternately, a first position where said lift plates contact the uppermost sheet and a second position where said lift plates are separated from the uppermost sheet by a predetermined distance, and said metal pawls allow movement of the uppermost sheet when said lift plates are moved into the second position.

5. A paper feeder according to claim 1, wherein said open/close mechanism includes a motor mounted on said paper feeder main body, and a drive shaft driven by said motor, said drive shaft having a first threaded portion screwed into one of said support plates and a second threaded portion, threaded in a direction opposite that of the first threaded portion, screwed into the other of said support plates.

6. A paper feeder for sequentially feeding sheets from the top of a rectangular, parallelepiped stack in a predetermined direction, comprising:

a paper feeder main body arranged above the sheet stack;

a feed roller, supported by said paper feeder main body and in contact with the uppermost sheet, for feeding the uppermost sheet in a predetermined direction;

drive means for driving said feed roller;

regulating means, arranged at a predetermined position with respect to the uppermost sheet, for allowing movement of the uppermost sheet and preventing movement of the other sheets; and support means, movable in accordance with a change in the height of the sheet stack upon sheet feed, for supporting said paper feeder main body and the regulating means at predetermined positions with respect to the uppermost sheet, said support means including a pair of support frames pivotally mounted on said paper feeder main body, rotating members which are mounted on said support frames to press against the respective sides of the stack, urging members for urging said support frames to urge said rotating members such that they press against the sides of the stack, a rotating member drive mechanism for driving said rotating members to move said support frames and said paper feeder main body, and a position sensor for detecting the position of said regulating means, with respect to the uppermost sheet, to control the operation of said rotating member drive mechanism.

7. A paper feeder according to claim 6, wherein said rotating members include endless belts.

8. A paper feeder according to claim 6, wherein said position sensor includes a photosensor.

9. A paper feeder for sequentially feeding sheets from the top of a rectangular, parallelepiped stack in a predetermined direction, comprising:

a paper feeder main body arranged above the sheet stack;

a feed roller, supported by said paper feeder main body and in contact with the uppermost sheet, for feeding the uppermost sheet in a predetermined direction;

drive means for driving said feed roller;

regulating means, arranged at a predetermined position with respect to the uppermost sheet, for allowing movement of the uppermost sheet and preventing movement of the other sheets; and support means, movable in accordance with a change in the height of the sheet stack upon sheet feed, for supporting said paper feeder main body and the regulating means at predetermined positions with respect to the uppermost sheet, said support means including fixed frames arranged opposite two opposite sides of the stack, a pair of support frames pivotally mounted on said paper feeder main body and engageable with said fixed frames, and an open/close mechanism for moving said support frames into both a first position, where said support frames are engaged with said fixed frames to support said main body, and a second position, where said support frames are separated from said fixed frames.

10. A printer comprising:

a base on which a rectangular, parallelepiped stack of a number of sheets is placed;

a printer main body; and a paper feeder for sequentially feeding the sheets from the uppermost sheet to said printer main body, said paper feeder including:

a paper feeder main body arranged above the sheet stack;

a feed roller, supported by said paper feeder main body and in contact with the uppermost sheet, for feeding the uppermost sheet in a predetermined direction;

drive means for driving said feed roller to advance the uppermost sheet in the predetermined direction;

regulating means, arranged at a predetermined position with respect to the uppermost sheet, for allowing movement of the uppermost sheet and preventing movement of the other sheets; and support means, movable in accordance with a change in the height of the sheet stack upon sheet feed, for supporting said paper feeder main body and said regulating means spaced above the uppermost sheet at times when the feed roller feeds the uppermost sheet, said printer main body being interconnected with said paper feeder for vertical movement therewith, wherein said printer main body and said paper feeder move vertically downward together as sheets are fed from the top of the sheet stack by said paper feeder.

11. A printer according to claim 10, wherein said base includes vertically extending guide means for guiding the movement of said printer main body relative to the sheet stack.

12. A reader comprising:

a base on which a rectangular, parallelepiped stack of a number of sheets is placed;

a reader main body; and a paper feeder for sequentially feeding the sheets from the uppermost sheet to said reader main body, said paper feeder including:

a paper feeder main body arranged above the sheet stack;

a feed roller, supported by said paper feeder main body and in contact with the uppermost sheet, for feeding the uppermost sheet in a predetermined direction;

drive means for driving said feed roller to advance the uppermost sheet in the predetermined direction;

regulating means, arranged at a predetermined position with respect to the uppermost sheet, for allowing movement of the uppermost sheet and preventing movement of the other sheets; and support means, movable in accordance with a change in the height of the sheet stack upon sheet feed, for supporting said paper feeder main body and said regulating means spaced above the uppermost sheet at times when the feed roller feeds the uppermost sheet, said reader main body being interconnected with said paper feeder for vertical movement therewith, wherein said reader main body and said paper feeder move vertically downward together as sheets are fed from the top of the sheet stack by said paper feeder.

* * * * *